US009243450B1

(12) United States Patent
Barnes

(10) Patent No.: US 9,243,450 B1
(45) Date of Patent: Jan. 26, 2016

(54) SYSTEM FOR OPERATING A DRILLING RIG WITH A RETRACTING GUIDE DOLLY AND A TOP DRIVE

(71) Applicant: LOADMASTER UNIVERSAL RIGS, INC., Houston, TX (US)

(72) Inventor: R. Michael Barnes, Magnolia, TX (US)

(73) Assignees: Canyon Oak Energy LLC, Houston, TX (US); Loadmaster Universal Rigs, Inc., Houston, TX (US)

( * ) Notice: Subject to any disclaimer, the term of this patent is extended or adjusted under 35 U.S.C. 154(b) by 446 days.

(21) Appl. No.: 13/679,997

(22) Filed: Nov. 16, 2012

Related U.S. Application Data

(60) Provisional application No. 61/587,519, filed on Jan. 17, 2012.

(51) Int. Cl.
*E21B 3/02* (2006.01)
*E21B 19/084* (2006.01)
*E21B 7/02* (2006.01)

(52) U.S. Cl.
CPC . *E21B 3/02* (2013.01); *E21B 7/022* (2013.01); *E21B 19/084* (2013.01)

(58) Field of Classification Search
CPC ..... E21B 15/00; E21B 15/045; E21B 19/084; E21B 19/155; E21B 19/16; E21B 19/165; E21B 19/161; E21B 19/166; E21B 19/24; E21B 7/022; E21B 3/02
USPC ..... 166/75.11, 85.5; 175/27
See application file for complete search history.

(56) References Cited

U.S. PATENT DOCUMENTS

| | | | | |
|---|---|---|---|---|
| 4,314,611 | A * | 2/1982 | Willis | 173/197 |
| 4,458,768 | A * | 7/1984 | Boyadjieff | 175/85 |
| 5,107,705 | A * | 4/1992 | Wraight et al. | 73/152.03 |
| 2005/0173154 | A1 * | 8/2005 | Lesko | 175/57 |
| 2008/0047749 | A1 * | 2/2008 | Koithan et al. | 175/40 |
| 2008/0125876 | A1 * | 5/2008 | Boutwell | 700/21 |
| 2009/0223200 | A1 * | 9/2009 | Kinert et al. | 59/84 |
| 2010/0259415 | A1 * | 10/2010 | Strachan et al. | 340/853.6 |

* cited by examiner

*Primary Examiner* — Blake Michener
*Assistant Examiner* — Christopher Sebesta
(74) *Attorney, Agent, or Firm* — Lowenstein Sandler LLP; Cicero H. Brabham, Jr.

(57) ABSTRACT

A top drive assembly having a top drive traveling block; a retracting guide dolly for use with the top drive traveling block and top drive operably by a master control system to hydraulically operate all of the top and bottom dolly arms simultaneously to extend and retract the top drive and top drive traveling block laterally and move the dolly as needed based on signals from a plurality of sensors disposed on the drilling rig, or on equipment adjacent the drilling rig.

10 Claims, 5 Drawing Sheets

SYSTEM FOR OPERATING A DRILLING RIG WITH A RETRACTING GUIDE DOLLY AND A TOP DRIVE

CROSS REFERENCE TO RELATED APPLICATION

The current application claims priority to and the benefit of U.S. Provisional Patent Application Ser. No. 61/587,519 filed on Jan. 17, 2012, entitled "METHOD FOR OPERATING A DRILLING RIG WITH A RETRACTING GUIDE DOLLY AND A TOP DRIVE." This reference is hereby incorporated in its entirety.

FIELD

The present embodiments generally relate to a top drive assembly for a drilling rig which can be operated by a master control system.

BACKGROUND

A need exists for a portable drilling rig that has a top drive that extends and retracts to provide quicker drilling.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a top drive assembly for a drilling rig which can be operated by a master control system.

The drilling rig can have a mast having a top drive, a top drive traveling block, a top drive drill line for lifting the top drive, and a drawworks connected to a power supply.

The top drive assembly operates on a retracting guide that can be controlled from a remote master control system.

The retracting guide dolly can include a first dolly engagement roller assembly and a second dolly engagement roller assembly operatively engaging a first side of the mast. The roller assemblies can be stabilized using guide dolly stabilizers.

A first dolly arm can be pivotably connected to the first dolly engagement roller assembly and the top drive, and a second dolly arm can be pivotably connected to the second roller assembly and the top drive.

A third dolly engagement roller assembly and a fourth dolly engagement roller assembly can be operatively engaged with a second side of the mast.

A third dolly arm can be pivotably connected to the third dolly engagement roller assembly and the top drive. A fourth dolly arm can be pivotably connected to the fourth dolly engagement roller assembly and the top drive.

A traveling block connects to the top drive and a traveling block dolly assembly.

The traveling block dolly assembly can include a first traveling block roller assembly engaged with the first side of the mast, and a second traveling block roller assembly engaged with the second side of the mast.

At least two traveling block arms can be pivotably connected to the traveling block and the traveling block roller assemblies.

A master control system can be used to pivot the dolly arms and the traveling block arms to retract the top drive laterally when the top drive and traveling block are traveling to a start position. The start position can be adjacent the crown when pipe is being ran into the wellbore and the drill floor when tubulars are being taken out of the wellbore.

The master control system can be operated from a first or second client device which can be a cell phone, a laptop, a computer, a tablet, or another type of processor. The master control system can be remote to the top drive assembly.

In one or more embodiments, the guide dolly arms and the traveling block arms can be connected using pivot pins and pad eyes.

The master control system can be used to pivot the dolly arms and the traveling block arms to extend the top drive laterally to engage one or more tubulars.

Figure 1:
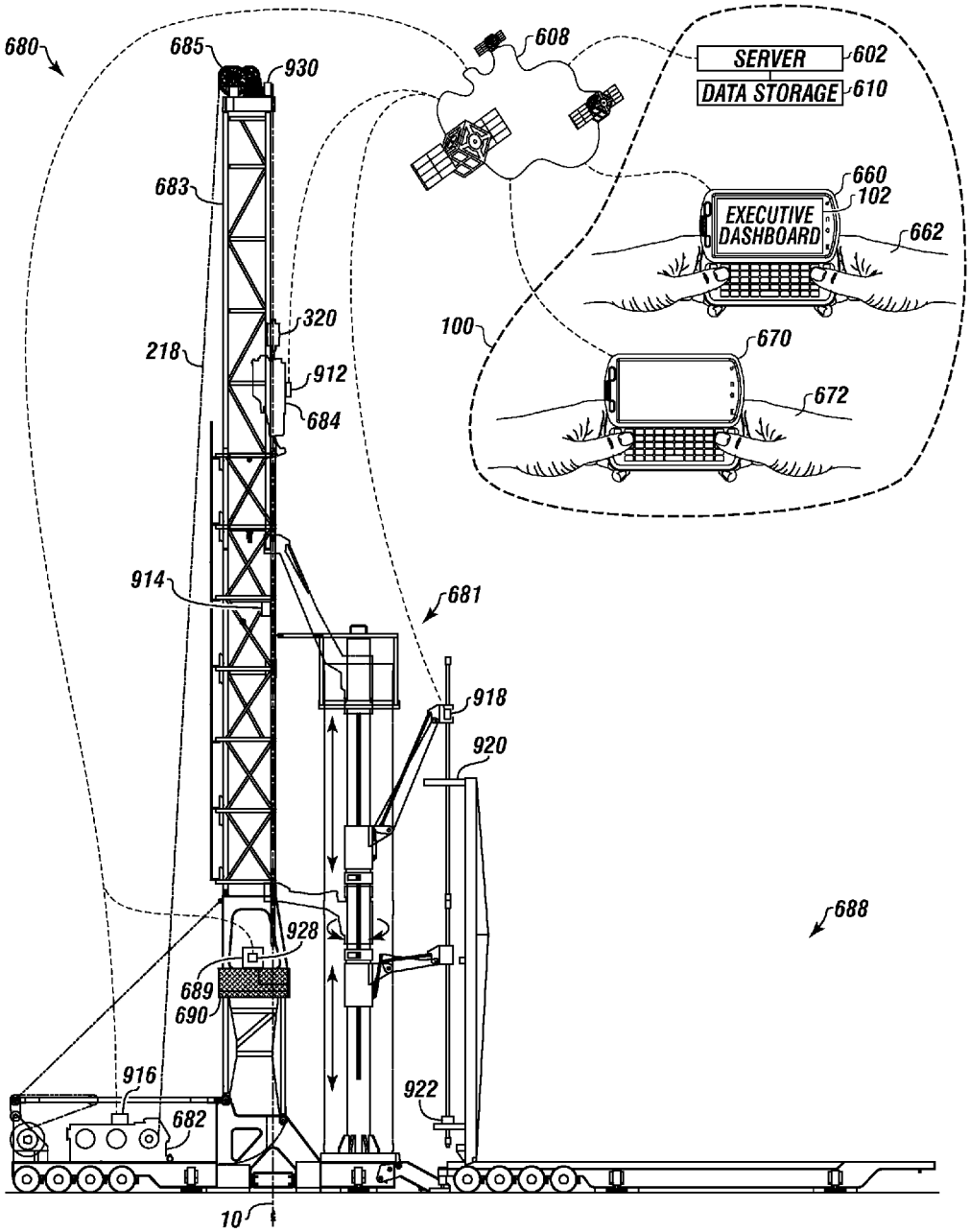
FIG. 1 depicts a schematic of a drilling rig system usable with the top drive assembly.

Turning now to the Figures, FIG. 1 depicts a schematic of a system configured to perform an operation on a tubular according to one or more embodiments.

Referring to FIG. 1, the master control system 100 can include a server 602. The server 602 can be in communication with a network 608.

The server 602 can be configured to execute computer instructions in one or more data storages, to communicate with devices via the network. The server 602 can be a PENTIUM™ processor, a computer, or a similar device.

In one or more embodiments, the server can be in a computing cloud.

The server can be a plurality of servers connected together, some in the computing cloud, some outside of the computing cloud connected to the network 608.

A data storage 610 can be connected with, integrated with, or otherwise in communication with the server 602.

In one or more embodiments, the data storage can be in a computing cloud. In one or more embodiments, a plurality of data storages can be used, some in a computing cloud, some outside of a computer cloud for operation of the master control system.

A first client device 660 and a second client device 670 can be in communication with the network 608. Accordingly, the client devices 660 and 670 can be in communication with the server 602 via the network 608.

The first client device 660 can have first client computer instructions for presenting an executive dashboard 102 of rig functions to a first user 662 which can include location of the top drive assembly 684 on the mast 683 of the drilling rig 680.

The second client device 670 can have second client device computer instructions for presenting the same executive dashboard of rig functions to a second user 672.

The master control 100 can be in communication with the drilling rig 680.

The drilling rig 680 can include a mast 683 with a drawworks 682, a top drive assembly 684, a rough neck 689 on a drill floor 690 of the drilling rig, and a top crown 685 on the mast.

A vertical pipe handler 681 and a horizontal to vertical pipe handler 688 can be connected to the drilling rig.

The drawworks 682 of the drilling rig can have a rotational speed monitoring device 916. The rotational speed monitoring device 916 can be any device capable of determining the rotational speed of the drawworks 682.

The vertical pipe handler 681 adjacent the drilling rig can have one or more vertical pipe handler monitoring devices 918. The vertical pipe handler monitoring device 918 can be configured to determine: if the arms are actuated, the position of the arms, or combinations thereof.

The top drive assembly 684 of the drilling rig can have one or more top drive monitoring devices 912. The top drive monitoring device 912 can be an accelerometer, a RFI tag, or another device capable of measuring the acceleration of the top drive, aiding in the determination by sending a signal or interacting with another monitoring device to cause a signal to be sent. For example, the top drive can have a chip or device configured to interact with one or more mast measuring devices 914 to cause a signal to be sent to the server 602.

The rough neck 689 of the drilling rig can be power tongs secured to a drill floor 690 of the drilling rig 680. The rough neck 689 can have one or more rough neck monitoring devices 928 configured to determine; if the rough neck 689 is in a closed position or an open position; and to determine the amount of torque forces applied to the rough neck; or combinations thereof.

The horizontal to vertical pipe handler 688 connected to the drilling rig can have one or more vertical pipe handler monitoring devices 920 and 922 configured to detect the location, speed, force applied to, how many tubulars are disposed thereon, the like, or combinations thereof.

The top crown 685 of the mast 683 can have one or more top crown monitoring devices 930 to determine the speed of drill line passing therethrough.

The monitoring devices 912, 916, 918, 920, 922, 928, and 930 can talk to the server through any form of telemetry. The mast measuring device 914 can also talk to the servicer though any form of telemetry. Illustrative examples of telemetry can include wired, wireless, acoustic, frequency, or combinations thereof.

The drilling rig 680 can be operatively aligned with a well center 10.

FIG. 1 also shows a top drive traveling block 320 secured to the top drive and a drill line 218 connected to drawworks 682, which are shown in detail in later Figures.

Figure 2:
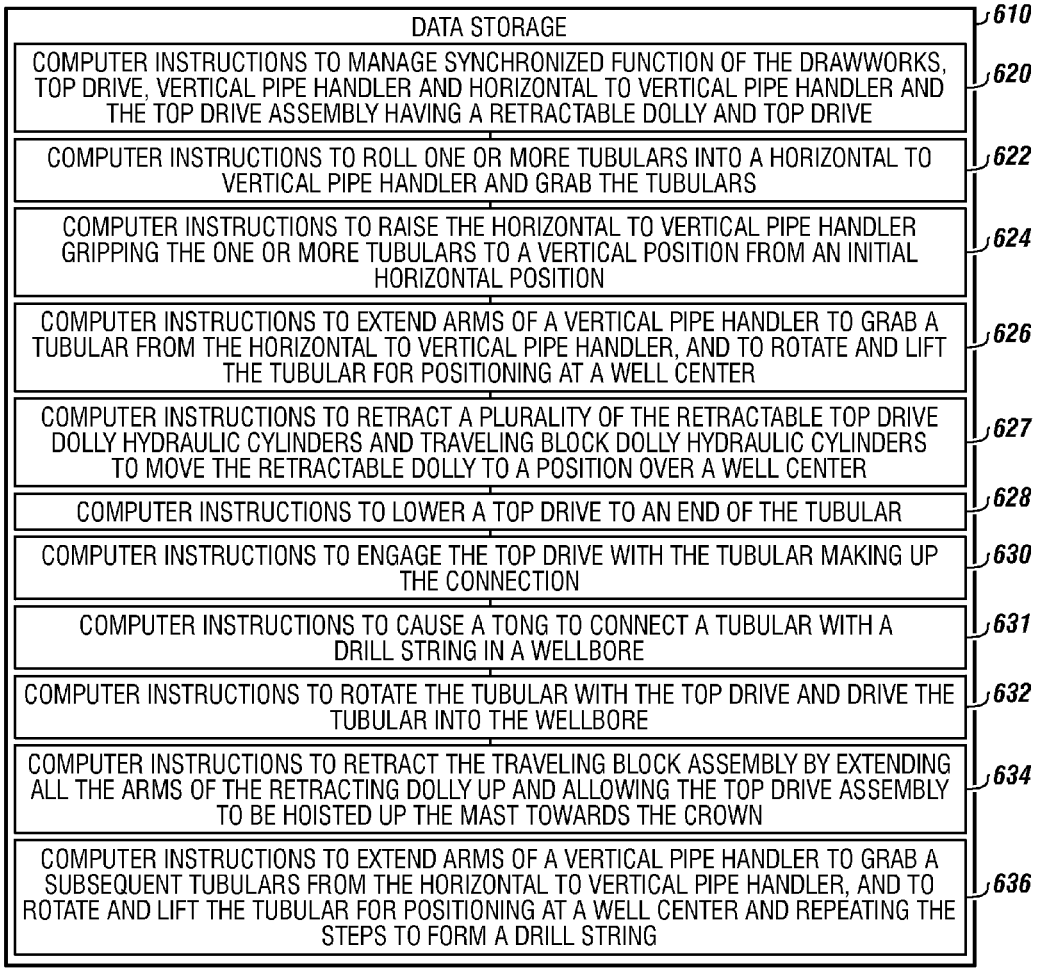
FIG. 2 depicts a detailed schematic of a data storage usable with the top drive assembly.

FIG. 2 depicts a detailed schematic of a data storage usable by the master control system according to one or more embodiments.

The data storage 610 can include computer instructions 620 to manage synchronized function of the drawworks, top drive, vertical pipe handler, horizontal to vertical pipe handler, and the top drive assembly having a retractable dolly and top drive.

The data storage 610 can include computer instructions 622 to roll one or more tubulars into a horizontal to vertical pipe handler and grab the tubulars.

The data storage 610 can include computer instructions 624 to raise the horizontal to vertical pipe handler gripping the one or more tubulars to a vertical position from an initial horizontal position.

The data storage 610 can include computer instructions 626 to extend arms of a vertical pipe handler to grab a tubular from the horizontal to vertical pipe handler, and to rotate and lift the tubular for positioning at a well center.

The data storage 610 can include computer instructions 627 to retract a plurality of the retractable top drive dolly hydraulic cylinders and traveling block dolly hydraulic cylinders to move the retractable dolly to a position over a well center.

The data storage 610 can include computer instructions 628 to lower a top drive to an end of the tubular.

The data storage 610 can include computer instructions 630 to engage the top drive with the tubular making up the connection.

The data storage 610 can include computer instructions 631 to cause a tong to connect a tubular with a drill string in a wellbore;

The data storage 610 can include computer instructions 632 to rotate the tubular with the top drive and drive the tubular into the wellbore.

The data storage 610 can include computer instructions 634 to retract the traveling block assembly by extending all the arms of the retracting dolly up and allowing the top drive assembly to be hoisted up the mast towards the crown.

The data storage 610 can include computer instructions 636 to extend arms of a vertical pipe handler to grab a subsequent tubulars from the horizontal to vertical pipe handler, and to rotate and lift the tubular for positioning at a well center and repeating the steps to form a drill string.

Figure 3:
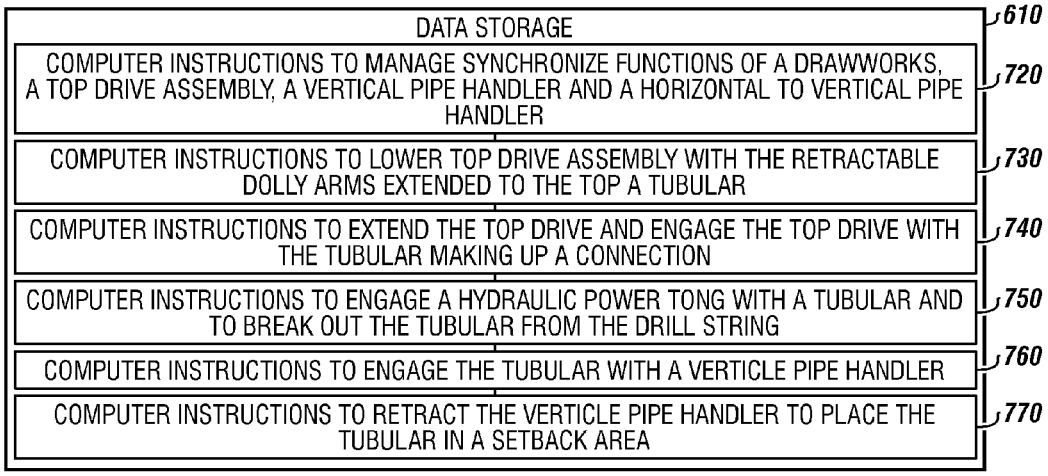
FIG. 3 depicts a detailed schematic of another data storage of a master control system usable with the top drive assembly.

FIG. 3 depicts a detailed schematic of a data storage according to one or more embodiments.

The data storage 610 can include computer instructions 720 to manage synchronize functions of a drawworks, a top drive assembly, a vertical pipe handler and a horizontal to vertical pipe handler.

The data storage 610 can include computer instructions 730 to lower the top drive assembly with the retractable dolly arms extended to the top a tubular.

The data storage 610 can include computer instructions 740 to extend the top drive and engage the top drive with the tubular making up a connection.

The data storage 610 can include computer instructions 750 to engage a hydraulic power tong with a tubular and to break out the tubular from the drill string.

The data storage 610 can include computer instructions 760 to engage the tubular with a vertical pipe handler.

The data storage 610 can include computer instructions 770 to retract the vertical pipe hander to place the tubular in a setback area.

Figure 4:
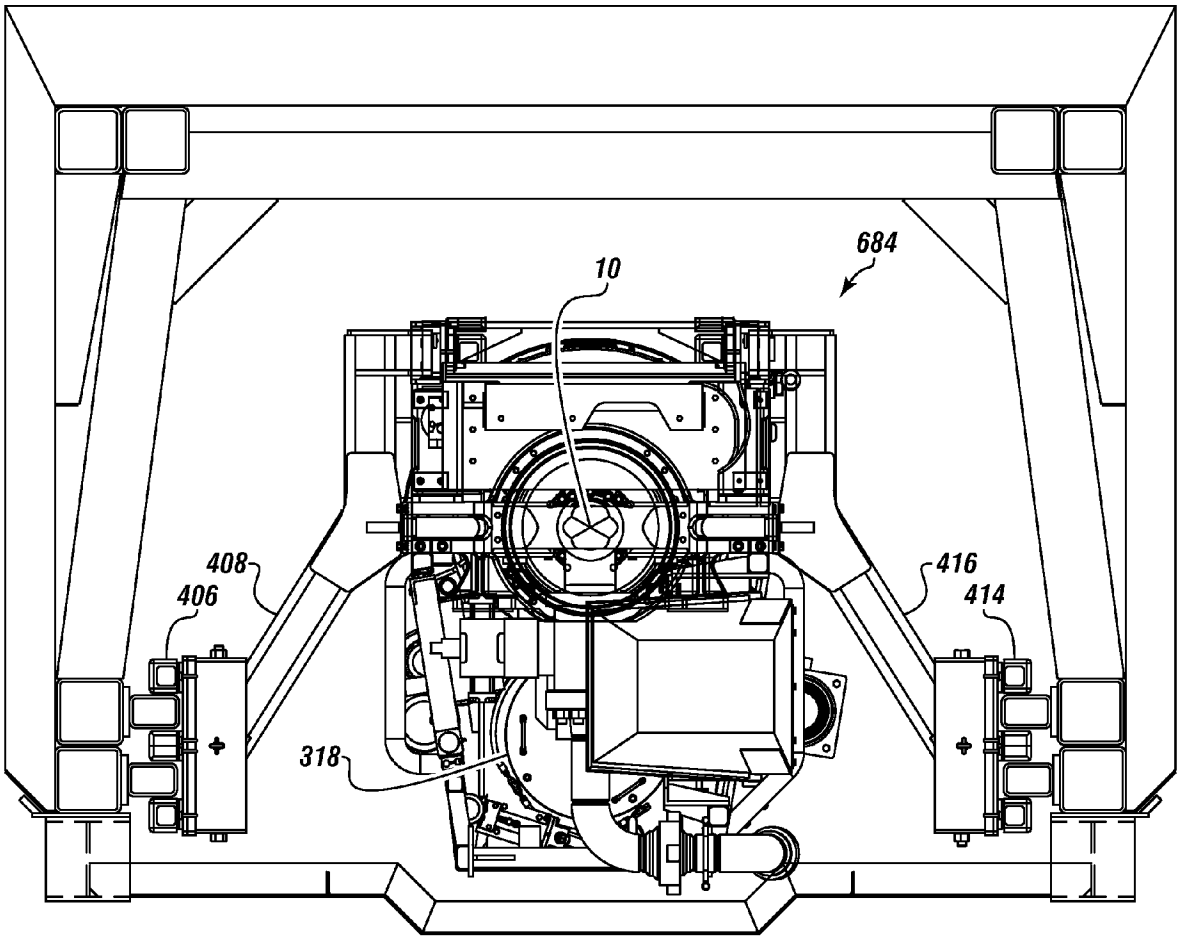
FIG. 4 depicts a plan view of the retracting guide dolly according to one or more embodiments.

FIG. 4 depicts a plan view of the top drive assembly according to one or more embodiments.

The top drive assembly 684 can include a top drive 318.

A second dolly arm 408 can be pivotably connected to a second dolly engagement roller assembly 406 and the top drive 318. A fourth dolly arm 416 can be pivotably connected to a fourth dolly engagement roller assembly 416 and the top drive 318.

The well center 10 can be viewed herein.

Figure 5:
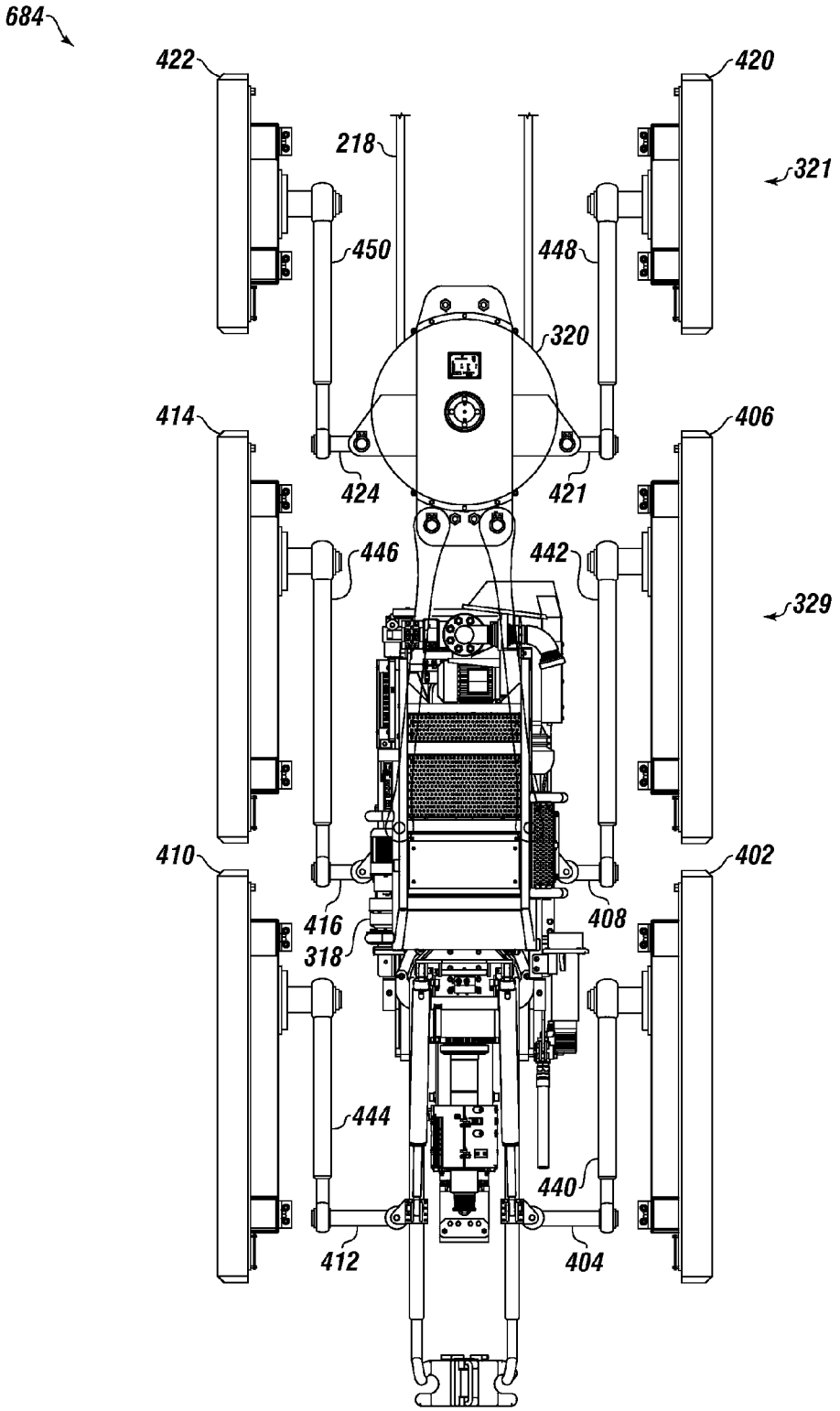
FIG. 5 is an elevation view of the top drive assembly with retracting guide dolly according to one or more embodiments.

FIG. 5 is an elevation view of the top drive assembly with retracting guide dolly according to one or more embodiments.

The top drive assembly 684 is shown with a retracting guide dolly 329. The top drive traveling block 320 is shown attached to the top drive 318 and the drill line 218.

A retracting guide dolly 329 can include a first dolly engagement roller assembly 402. The retracting guide dolly 329 can be connected to the top drive 318 for ensuring the top drive is positioned over the well center.

A first dolly arm 404 can be pivotably connected to the first dolly engagement roller assembly 402 and the top drive 318.

The second dolly engagement roller assembly 406 can be axially aligned with the first dolly engagement roller assembly 402.

A second dolly arm 408 can be pivotably connected to the second dolly engagement roller assembly 406 and the top drive 318.

A third dolly engagement roller assembly 410 is shown disposed on an opposite side of the top drive 318.

A third dolly arm 412 can be pivotably connected to the third dolly engagement roller assembly 410 and the top drive 318.

A fourth dolly engagement roller assembly 414 can be operatively aligned with the third dolly engagement roller assembly 410.

A fourth dolly arm 416 can be pivotably connected to the fourth dolly engagement roller assembly 414 and the top drive 318.

A plurality of hydraulic cylinders 440, 442, 444, 446, 448 and 450 can be connected to a power unit, such as hydraulic power unit.

The traveling block dolly assembly 321 can be secured to the top drive traveling block 320.

The traveling block dolly assembly 321 can have a first traveling block roller assembly 420; a second traveling block roller assembly 422; a first traveling block arm 421 can be pivotably connected to the first traveling block roller assembly 420 and the top drive traveling block 320; a second traveling block arm 424 can be pivotably connected to the second traveling block roller assembly 422 and the top drive traveling block 320.

While these embodiments have been described with emphasis on the embodiments, it should be understood that within the scope of the appended claims the embodiments might be practiced other than as specifically described herein.

What is claimed is:

1. A top drive assembly for a drilling rig comprising:

a. a top drive;

b. a retracting guide dolly connected to the top drive for ensuring the top drive is positioned over a well center, wherein the retracting guide dolly comprises:

(i) a first dolly engagement roller assembly;

(ii) a first dolly arm pivotably connected to the first dolly engagement roller assembly and the top drive;

(iii) a second dolly engagement roller assembly axially aligned with the first dolly engagement roller assembly;

(iv) a second dolly arm pivotably connected to the second dolly engagement roller assembly and the top drive;

(v) a third dolly engagement roller assembly disposed on an opposite side of the top drive as the first roller;

(vi) a third dolly arm pivotably connected to the third dolly engagement roller assembly and the top drive;

(vii) a fourth dolly engagement roller assembly operatively aligned with the third dolly engagement roller assembly; and (viii) a fourth dolly arm pivotably connected to the fourth dolly engagement roller assembly and the top drive;

wherein each dolly arm is extendable and retractable relative to the corresponding dolly engagement roller assembly;

c. a top drive traveling block attached to the top drive and a drill line;

d. a traveling block dolly assembly secured to the top drive traveling block, wherein the traveling block dolly assembly comprises:

(i) a first traveling block roller assembly;

(ii) a second traveling block roller assembly;

(iii) a first traveling block arm pivotably connected to the first traveling block roller assembly and the top drive traveling block; and (iv) a second traveling block arm pivotably connected to the second traveling block roller assembly and the top drive traveling block;

e. a plurality of hydraulic cylinders, wherein one of the hydraulic cylinders engages at least one dolly arm or at least one traveling block arm; and f. a master control system for controlling the top drive assembly from a remote location.

2. The top drive assembly for a drilling rig of claim 1, wherein the master control system comprises:

a. a first user device to provide commands to the top drive assembly over a network;

b. a server with data storage in communication with the network; and c. a plurality of computer instructions in the data storage connected to the server allowing one of the user devices to monitor and command the top drive assembly.

3. The top drive assembly for a drilling rig of claim 1, further comprising a top drive monitoring device mounted on the top drive for providing signals on top drive operation to the master control system.

4. The top drive assembly for a drilling rig of claim 3, further comprising a mast measuring device positioned on a mast of the drilling rig for providing a signal to the master control system indicating a location of the top drive assembly on the mast.

5. The top drive assembly for a drilling rig of claim 2, further comprising a rotational speed monitoring device in communication with the master control system providing a rotational speed provided by a drawworks for controlling use of the top drive assembly.

6. The top drive assembly for a drilling rig of claim 2, further comprising a vertical pipe handler monitoring device on a vertical pipe handler connected to the drilling rig in communication with the master control system for use controlling the top drive assembly.

7. The top drive assembly for a drilling rig of claim 3, wherein the top drive monitoring device is a member of the group comprising of:

a. an accelerometer;

b. a radio frequency identification (RFID) tag;

c. a processor coupled to one or more mast measuring devices, the processor to cause a signal to be sent to the server; or d. combinations thereof.

8. The top drive assembly for a drilling rig of claim 1, wherein the drilling rig further comprises:

a. power tongs secured to a drill floor of the drilling rig; and b. at least one rough neck monitoring device connected to the drilling rig in communication with the master control system for use controlling the top drive assembly, the at least one rough neck monitoring device configured to determine:

(i) an open position of the power tongs;

(ii) a closed position of the power tongs;

(iii) torque force applied to the power tongs.

9. The top drive assembly for a drilling rig of claim 1, further comprising at least one vertical pipe handler monitoring device configured to detect a location of a tubular, the at least one vertical pipe handler monitoring device being in communication with the master control system for use controlling the top drive assembly.

10. The top drive assembly for a drilling rig of claim 1, further comprising a top crown monitoring device located on a top crown of the drilling rig to determine the speed of any line passing through the top crown, wherein the top crown monitoring device is in communication with a server for controlling the top drive assembly.

* * * * *